US006740202B2

(12) United States Patent
Ishigaki et al.

(10) Patent No.: US 6,740,202 B2
(45) Date of Patent: May 25, 2004

(54) SPEAKER DIAPHRAGM AND METHOD OF MANUFACTURING SAME

(75) Inventors: Toshihiro Ishigaki, Yamagata-ken (JP); Hideo Sekikawa, Yamagata-ken (JP); Koji Maekawa, Yamagata-ken (JP); Tomoyuki Shimada, Kanagawa-ken (JP)

(73) Assignees: Pioneer Corporation, Tokyo (JP); Tohoku Pioneer Corporation, Yamagata-ken (JP); Nippan Kenkyujo Co., Ltd., Kanagawa-ken (JP)

( * ) Notice: Subject to any disclaimer, the term of this patent is extended or adjusted under 35 U.S.C. 154(b) by 91 days.

(21) Appl. No.: 10/108,558

(22) Filed: Mar. 29, 2002

(65) Prior Publication Data

US 2002/0140136 A1 Oct. 3, 2002

(30) Foreign Application Priority Data

Apr. 2, 2001 (JP) ..... 2001-103117

(51) Int. Cl.[7] ..... D21H 3/12

(52) U.S. Cl. ..... 162/218; 162/181.1; 162/181.4; 162/181.6; 162/228; 181/167; 181/169; 381/426; 381/428

(58) Field of Search ..... 181/167, 169; 162/181.1, 181.6, 181.4, 181.5, 218, 228, 231; 381/426, 428

(56) References Cited

U.S. PATENT DOCUMENTS 4,410,768 A * 10/1983 Nakamura et al. .... 179/115.5 R
4,428,996 A * 1/1984 Miyoshi et al. ..... 428/198

* cited by examiner

*Primary Examiner*—Peter Chin
(74) *Attorney, Agent, or Firm*—Arent Fox Kintner Plotkin & Kahn, PLLC

(57) ABSTRACT

A speaker diaphragm is formed from a material combining a fiber-type material and a ceramic-type-coating agent including metal alkoxide, metal hydroxide, and a colloidal or fine-particulate inorganic substance. The combining process for the ceramic-type-coating agent is performed before or after the fiber-type material is formed into a shape of the diaphragm.

15 Claims, 6 Drawing Sheets

FIG.2

| COMPOSITION OF CERAMIC-TYPE-COATING AGENT (PART BY WEIGHT IN SOLID) | | COMPOSITION EXAMPLE 1 | COMPOSITION EXAMPLE 2 | COMPOSITION EXAMPLE 3 |
|---|---|---|---|---|
| ALKOXY METAL | TETRAETHYL SILICATE (42) | | 15(6. 3) | |
| ALKOXY METAL | TETRABUTYL SILICONATE (33) | | 5(1. 6) | |
| ORGANOALKOXY METAL | TRIMETHYLMETHOXYSILANE (48) | 30(14. 4) | | |
| SILICONE VARNISH | METHYL SILICONE VARNISH (55) | | 45(24. 7) | |
| ALKALI METAL SALT | LITHIUM SILICATE (21) | | | 40(8. 4) |
| SILICONE VARNISH EMULSION | METHYL SILICONE EMULSION (48) | | | 25(12. 0) |
| COLLOIDAL INORGANIC SUBSTANCE | AQUEOUS COLLOIDAL ALUMINA (20) | 45(9. 0) | | |
| FINE-PARTICULATE INORGANIC SUBSTANCE | IRON-COPPER-MANGANESE SYNTHETIC OXIDE—AVERAGE PARTICLE DIAMENTER 0. 5 μ | | 5(5. 0) | 2(2. 0) |
| FINE-PARTICULATE INORGANIC SUBSTANCE | ALUMINUM HYDROXIDE-AVERAGE PARTICLE DIAMENTER1 μ | | | 8(8. 0) |
| ORGANIC SOLVENT | ISOPROPANOL | 25 | | |
| ORGANIC SOLVENT | n—BUTANOL | | 30 | |
| WATER | ION-EXCHANGED WATER | | | 25 |
| TOTAL | | 100 | 100 | 100 |
| (TOTAL SOLIDS CONTENT) | | 23. 4 | 37. 6 | 30. 4 |
| SURFACE ACTIVE AGENT | SILICONE-TYPE LEVELING AGENT | 0. 5 | | 0. 5 |
| ACETIC ACID | | | 1. 0 | |

( )NUMERALS INSIDE PARENTHESES ARE PART BY WEIGHT IN SOLID

FIG.3

| | THICKNESS (mm) | SPECIFIC GRAVITY ( g/cm$^3$) | YOUNG'S MODULUS ($\times 10^9$N/m$^2$) | INTERNAL LOSS |
|---|---|---|---|---|
| CONVENTIONAL ART1 (HEAT-RESISTANT RESIN FILM OF POLYIMIDE) | 0.08 | 1.50 | 4.6 | 0.021 |
| CONVENTIONAL ART2 (GLASS CLOTH) | 0.08 | 1.24 | 1.6 | 0.032 |
| PRESENT INVENTION (IMPREGNATING GLASS CLOTH WITH ALKOXY METAL) | 0.10 | 1.26 | 4.5 | 0.019 |

FIG.4

| | THICKNESS (mm) | SPECIFIC GRAVITY ( g/cm$^3$) | YOUNG'S MODULUS ($\times 10^9$N/m$^2$) | INTERNAL LOSS |
|---|---|---|---|---|
| CONVENTIONAL ART1 (NOT-TREATED PAPER-PULP) | 0.340 | 0.518 | 1.29 | 0.0292 |
| PRESENT INVENTION (IMPREGNATION WITH ALKOXY METAL) | 0.376 | 0.514 | 1.49 | 0.0367 |
| PRESENT INVENTION (IMPREGNATION WITH ZIRCONIA SILICON) | 0.406 | 0.520 | 1.62 | 0.0214 |

SPEAKER DIAPHRAGM AND METHOD OF MANUFACTURING SAME

BACKGROUND OF THE INVENTION

1. Field of the Invention

This invention relates to a speaker diaphragm and a method of manufacturing the speaker diaphragm.

The present application claims priority from Japanese Application No. 2001-103117, the disclosure of which is incorporated herein by reference for all purposes.

2. Description of the Related Art

Conventionally, as the base materials for forming speaker diaphragms, flammable materials, such as paper, a variety of resins, fabrics or the like, are typically employed because of their lightweight properties and low cost.

Accordingly, when an abnormal current flows through the speaker or when abnormal heating occurs on the periphery of the speaker, there may be cases where an accidental fire originates in the diaphragm, which has the largest area among the parts making up the speaker, and spreads.

Paper, woven fabric and non-woven fabric are most commonly used due to they having the lightest weight and the lowest cost among conventional materials for diaphragms, but they typically are so high in hygroscopicity or water-absorption properties that after the paper, woven fabrics or non-woven fabrics absorbs moisture or water, the binding between fibers making up the material decrease, resulting in a decrease in strength of the material.

Therefore, a problem is that the paper, woven fabric and non-woven fabric are unfit for diaphragms of speakers placed in harsh use-environments where water is directly poured on it or in humid surroundings, e.g., a vehicle-mounted speaker.

Moreover, in order to enhance extension of a high-pitched tone in the speaker, the speaker needs a hard and lightweight diaphragm.

With the conventional diaphragms using paper, the diaphragm is made to be hard by mixing a paper pulp with fibers, such as carbon fiber, or an inorganic substance, such as mica, as a filler in making paper or by impregnating paper with resin.

However, though mixing the paper pulp with the filler or impregnating paper with resin can provide a hard diaphragm to a certain extent, this has not been able to provide a diaphragm satisfying the requirements for a tweeter serving as a speaker designed specially for high frequency.

As the diaphragms for the tweeter, conventionally, a variety of materials are used: for example, metal such as aluminium, beryllium and titanium, a resin film made of polyimide or the like, and carbon.

However, there is a problem that the metal is heavy in weight and the resin film made of polyimide or the like, and carbon are high in cost.

SUMMARY OF THE INVENTION

The present invention has been made to solve the problems associated with the conventional speaker diaphragms as described above.

It is therefore a first object of the present invention to provide a speaker diaphragm having water resistance and humidity resistance without the possibility of an accidental fire, and having a high rigidity with light weight.

Further, it is a second object of the present invention to provide a method of manufacturing a speaker diaphragm allowing the attainment of the first object.

To attain the first object, a speaker diaphragm according to a first aspect of the present invention has the feature of including a material resulting from combining a ceramic-type-coating agent with a fiber-type material.

The speaker diaphragm according to the first aspect is formed by various methods; for example, the fiber-type material is formed into an arbitrary shape of the diaphragm, and then combined with the ceramic-type-coating agent through impregnation or coating; the ceramic-type-coating agent is mixed into the beaten fiber-type material and then processed into paper to form an arbitrary shape of the diaphragm; the fiber-type material is impregnated or coated with the ceramic-type-coating agent, then beaten, and then processed into paper to form an arbitrary shape of the diaphragm.

According to the first aspect, the covering of the surface of the fiber-type material, which is a base material of the speaker diaphragm, with a ceramic film causes the speaker diaphragm to be incombustible or flame-retardant. This prevents the speaker from bursting into flames as a result of the diaphragm catching fire.

Further, the ceramic film formed by the ceramic-type-coating agent having been combined with the fiber-type material increases the rigidity of the diaphragm. Hence, it is possible to significantly improve the endurance against impact even when the diaphragm is placed in a vehicle-mounted speaker, for example.

Still further, the ceramic film formed by the ceramic-type-coating agent having been combined with the fiber-type material improves humidity resistance and water resistance and strengthens the binding between the fibers. Hence, the environmental resistance including thermal resistance is improved to allow the diaphragm to be used in speakers which are placed in harsh environments where water is directly poured on it or the temperature and humidity are high, as in the case of a vehicle-mounted speaker, for example.

Further, according to the first aspect, the impregnation or coating of a fiber-type material, such as paper pulp, or a cloth material, such as glass cloth, with the ceramic-type-coating agent allows the provision of the lightweight and high-rigid diaphragm at low cost.

The use of ceramic for the diaphragm allows a significant extension of the high frequency characteristics of the speaker.

To attain the first object, a speaker diaphragm according to a second aspect of the present invention has the feature, in addition to the configuration of the first aspect, that the ceramic-type-coating agent is a ceramic-type-coating agent made up of at least one item selected from the group consisting of an alkoxy metal, a hydrolysate of the alkoxy metal and a partial condensation product of the hydrolysate.

With the speaker diaphragm according to the second aspect, after the ceramic-type-coating agent made up of at least one item selected from the group consisting of an alkoxy metal, a hydrolysate of the alkoxy metal and a partial condensation product of the hydrolysate, is applied to the fiber-type material such as paper or resin, the ceramic-type-coating agent is hardened at room temperatures or by low-temperature heating, and undergoes hydrolysis and a polycondensation reaction, to form a ceramic film which is noncombustible and outstanding in thermal resistance and weather resistance, and has a high water repellency and water proofing property due to its high density, and also electrical-insulation properties, and shock impact resistance due to its high degree of hardness.

To attain the first object, a speaker diaphragm according to a third aspect has the feature, in addition to the configuration of the first aspect, that the ceramic-type-coating agent is a ceramic-type-coating agent made up of at least one item selected from the group consisting of mixtures of an alkoxy metal and a silicone varnish.

With the speaker diaphragm according to the third aspect, the ceramic-type-coating agent made up of at least one item selected from the group consisting of mixtures of an alkoxy metal and a silicone varnish, which is combined with the fiber-type material serving as the base material of the diaphragm, is hardened at room temperatures or by low-temperature heating, to form a ceramic film which has noncombustibility, thermal resistance, weather resistance and electrical-insulation properties, and is outstanding in damage resistance due to its high degree of hardness.

To attain the first object, a speaker diaphragm according to a fourth aspect has the feature, in addition to the configuration of the first aspect, that the ceramic-type-coating agent is a ceramic-type-coating agent made up of at least one item selected from the group consisting of mixtures of alkali metal salt and silicone varnish emulsion.

With the speaker diaphragm of the fourth aspect, metal alkoxide and metal hydroxide are used for the ceramic-type-coating agent to be combined with the fiber-type material serving as the base material of the diaphragm.

The above ceramic-type-coating agent includes a ceramic-type-coating agent formed of metal alkoxide, metal hydroxide, and a colloidal or fine-particulate inorganic substance.

The above ceramic-type-coating agent is hardened at room temperatures or by low-temperature heating, to form a ceramic film which has noncombustibility, thermal resistance, weather resistance and electrical-insulation properties, and is outstanding in damage resistance due to its high degree of hardness.

To attain the first object, a speaker diaphragm according to a fifth aspect has the feature, in addition to the configuration of the first aspect, that the ceramic-type-coating agent is a ceramic-type-coating agent including a colloidal inorganic substance or a fine-particulate inorganic substance having favorable heat-emission properties. The above ceramic-type-coating agent is combined with the fiber-type material serving as the base material of the diaphragm, to form a ceramic film having noncombustibility, thermal resistance, weather resistance and electrical-insulation properties, and be outstanding for damage resistance due to its high degree of hardness.

A speaker diaphragm according to a sixth aspect has the feature, in association with the fifth aspect, that the colloidal inorganic substance or the fine-particulate inorganic substance having favorable heat-emission properties is an impalpable powder of metal oxide having the property of converting heat into infrared radiation for emission.

To attain the first object, a speaker diaphragm according to a seventh aspect has the feature, in addition to the configuration of the first aspect, that a fine-particulate inorganic substance is adhered to the surface of the speaker diaphragm. This allows adjustment of the vibration frequency of the speaker diaphragm, sound reflection and sound absorption for improving the sound quality, and the setting of a desired sound quality.

A speaker diaphragm according to an eighth aspect has the feature, in association with the seventh aspect, that the fine-particulate inorganic substance is a fine-particulate inorganic substance consisting of at least one item selected from the group consisting of a particulate metal, metal oxide, metal hydroxide, metal nitride, and metal carbide.

To attain the first object, a speaker diaphragm according to a ninth aspect has the feature, in addition to the configuration of the first aspect, that the ceramic-type-coating agent is a ceramic-type-coating agent including a scaly inorganic substance or a short-fibrous whisker inorganic substance. The ceramic-type-coating agent is combined with the fiber-type material serving as the base material of the diaphragm, to form a ceramic film having noncombustibility, thermal resistance, weather resistance and electrical-insulation properties, and outstanding in damage resistance due to its high degree of hardness.

A speaker diaphragm according to a tenth aspect has the feature, in association with the ninth aspect, that the scaly inorganic substance or the short-fibrous whisker inorganic substance is a fine-particulate inorganic substance consisting of at least one item selected from the group consisting of a particulate metal, metal oxide, metal hydroxide, metal nitride, and metal carbide.

To attain the first object, a speaker diaphragm according to an eleventh aspect has the feature, in addition to the configuration of the first aspect, that the fiber-type material is either a paper-pulp based material, a woven fabric or a non-woven fabric.

With the speaker diaphragm of the eleventh aspect, the paper-pulp based material is beaten and then processed into paper or the woven fabric or non-woven fabric is pressed, for formation into an arbitrary shape of the diaphragm.

Due to the combining of the ceramic-type-coating agent with the paper-pulp based material, woven fabric or non-woven fabric, even when the diaphragm is formed from a fiber-type material which is a flammable base material, it is possible for the diaphragm to maintain noncombustibility or flame retardancy, water resistance, and humidity resistance.

To attain the second object, a method of manufacturing a speaker diaphragm according to a twelfth aspect of the present invention includes the step of forming a material resulting from combining a ceramic-type-coating agent with a fiber-type material into an arbitrary shape of the speaker diaphragm.

According to the method of manufacturing the speaker diaphragm of the twelfth aspect, the covering of the surface of the fiber-type material, which is a base material of the speaker diaphragm, with a ceramic film causes the speaker diaphragm to be incombustible or flame-retardant. This prevents the speaker from bursting into flames as a result of the diaphragm catching fire.

Further, the ceramic film formed by the ceramic-type-coating agent having been combined with the fiber-type material increases the rigidity of the diaphragm. Hence, it is possible to significantly improve the endurance against impact even when the diaphragm is placed in a vehicle-mounted speaker, for example.

Still further, the ceramic film formed by the ceramic-type-coating agent having been combined with the fiber-type material improves humidity resistance and water resistance and strengthens the binding between the fibers. Hence, the environmental resistance including thermal resistance is improved to allow the diaphragm to be used in speakers which are placed in harsh environments where water is directly poured on it or the temperature and humidity are high, as in the case of a vehicle-mounted speaker, for example.

Further, according to the twelfth aspect, the impregnation or coating of a fiber-type material, such as paper pulp, or a cloth material, such as glass cloth, with the ceramic-type-coating agent allows the provision of the lightweight and high-rigid diaphragm at low cost.

The use of ceramic for the diaphragm allows a significant extension of the high frequency characteristics of the speaker.

To attain the second object, a method of manufacturing a speaker diaphragm according to a thirteenth aspect of the present invention, in addition to the configuration of the twelfth aspect, includes the steps of: forming the fiber-type material into an arbitrary shape of the diaphragm; and impregnating or coating the fiber-type material, formed into the arbitrary shape of the diaphragm, with the ceramic-type-coating agent, in order to manufacture the speaker diaphragm.

According to the method of manufacturing the speaker diaphragm of the thirteenth aspect, for the formation into the shape of the diaphragm, when the fiber-type material serving as the base material is paper, the pulp or beaten paper-fibers are processed into paper. When the fiber-type material is woven fabric or non-woven fabric, the fabric sheet is pressed. The fiber-type material formed into the required shape of the diaphragm is impregnated or coated with the ceramic-type-coating agent.

Then the ceramic-type-coating agent with which the shaped fiber-type material is impregnated or coated is solidified at room temperatures or by low-temperature heating to form a ceramic film on the surface of the fiber-type material.

To attain the second object, a method of manufacturing a speaker diaphragm according to a aspect, in addition to the configuration of the twelfth aspect, includes the steps of: mixing the ceramic-type-coating agent into the fiber-type material in a separated fiber state before shaping; and processing the fiber-type material, mixed with the ceramic-type-coating agent, into paper for formation into an arbitrary shape of a diaphragm of a speaker in order to manufacture the speaker diaphragm.

According to the method of manufacturing the speaker diaphragm of the aspect, the ceramic-type-coating agent which is mixed into the fiber-type material and then is processed together with the fiber-type material into paper, is solidified at room temperatures or by low-temperature heating to form a ceramic film on the surface of the fiber-type material having the shape of the diaphragm.

To attain the second object, a method of manufacturing a speaker diaphragm according to a fifteenth aspect, in addition to the configuration of the twelfth aspect, includes the steps of: impregnating or coating the fiber-type material with the ceramic-type-coating agent; beating the fiber-type material impregnated or coating with the ceramic-type-coating agent; and processing the beaten fiber-type material into paper for formation into an arbitrary shape of a diaphragm of a speaker in order to manufacture the speaker diaphragm.

According to the method of manufacturing the speaker diaphragm of the fifteenth aspect, the ceramic-type-coating agent with which the fiber-type material is impregnated or coated is solidified at room temperatures or by low-temperature heating to produce a ceramic film. The resulting fiber-type material is beaten and then the diaphragm of the required shape is formed by the fibers on which the ceramic film is produced.

These and other objects and features of the present invention will become more apparent from the following detailed description with reference to the accompanying drawings.

BRIEF DESCRIPTION OF THE DRAWINGS

FIG. 2 is a table showing an example of composition of a ceramic-type-coating agent relating to the present invention.

FIG. 3 is a table showing the characteristics of a speaker diaphragm made from conventional materials and a speaker diaphragm according to the present invention.

FIG. 4 is a table showing the characteristics of a cone diaphragm made up of a conventional paper-pulp without any treatment, and a cone diaphragm relating to the present invention.

DETAILED DESCRIPTION OF THE PREFERRED EMBODIMENT

A preferred embodiment according to the present invention will be described hereinafter.

Figure 1:
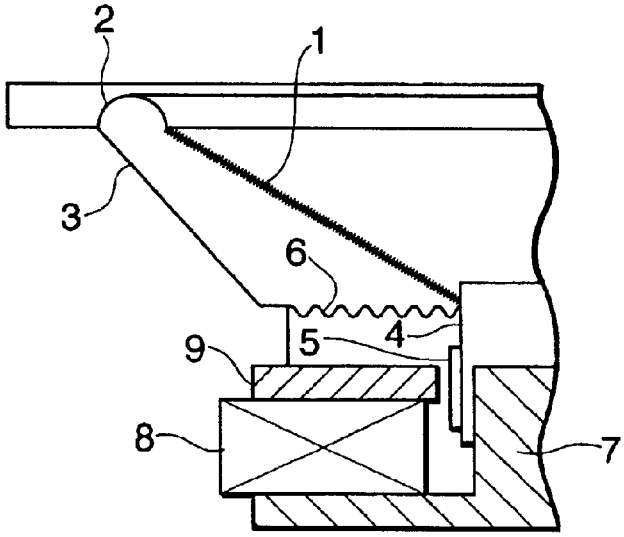
FIG. 1 is a sectional side view illustrating a configuration of a speaker mounted with a diaphragm according to the present invention.

FIG. 1 is a sectional side view illustrating a typical configuration of a speaker mounted with a diaphragm according to the present invention.

A diaphragm 1, which is formed into a cone shape by use of a base material which is subjected to treatment-processing by a manufacturing method according to the present invention as described later, has the outer peripheral edge attached to a frame 3 through an edge 2 and the inner peripheral edge attached to the outer periphery of one end of a voice coil bobbin 4.

Referring to FIG. 1, there are a voice coil 5 wound on the outer periphery of the voice coil bobbin 4, a damper 6 supporting the voice coil bobbin 4 to allow it to vibrate in the axis direction with respect to the frame 3, a yoke 7, a magnet 8, and a plate 9 for forming a magnetic field between the yoke 7 and the plate 9.

To produce a material for forming the speaker diaphragm 1, a paper-pulp based material (e.g., a mixture consisting of a kraft pulp and a rigid pulp), woven fabric or non-woven fabric serving as a base material is combined with ceramic by a process of impregnation or coating with a ceramic-type-coating agent.

The ceramic-type-coating agent to be combined with the base material in order to produce the material for forming the diaphragm 1 consists of at least one item selected from the group consisting of an alkoxy metal, a hydrolysate of the alkoxy metal and a partial condensation product of the hydrolysate.

The alkoxy metal used in the present invention is hydrolyzed by the presence of water to result in a hydrolysate. The hydrolysate undergoes polycondensation to produce a partial polycondensation product to simply increase molecular weight to produce a thin film of metal oxide which is a complete condensation product.

The alkoxy metal is expressed by a general formula $M(OR)_n$ or $R'M(OR)_{n-1}$ (wherein M denotes Si, Al, Ti, and Zr, R denotes an alkyl group having the carbon number of 1 to 5 or an acyl group having the carbon number of 1 to 4, R' denotes an organic group having the carbon number of 1 to 8, and n denotes an integral number of 3 or 4), which includes a hydrolysate of the alkoxy metal or a partial condensation product thereof.

It is possible for such compounds to be a combination of one or more than one items and also to be a compound resulting from the condensation of more than one item.

Specific examples of the alkoxy metal include as follows: $Si(OCH_3)_4$, $Si(OC_2H_5)_4$, $Si(OC_3H_7)_4$, $Si(OC_4H_9)_4$, $CH_3Si(OCH_3)_3$, $CH_3Si(OC_2H_5)_3$, $CH_3Si(OC_3H_7)_3$, $CH_3Si(OC_4H_9)_3$, $C_2H_5Si(OCH_3)_3$, $C_2H_5Si(OC_2H_5)_3$, $C_2H_5Si(OC_3H_7)_3$, $C_2H_5Si(OC_4H_9)_3$, $Al(OCH_3)_3$, $Al(OC_2H_5)_3$, $Al(OC_3H_7)_3$, $Al(OC_4H_9)_3$, $CH_3Al(OCH_3)_2$, $CH_3Al(OC_2H_5)_2$, $CH_3Al(OC_3H_7)_2$, $CH_3Al(OC_4H_9)_2$, $C_2H_5Al(OCH_3)_2$, $C_2H_5Al(OC_2H_5)_2$, $C_2H_5Al(OC_3H_7)_2$, $C_2H_5Al(OC_4H_9)_2$, $Ti(OCH_3)_4$, $Ti(OC_2H_5)_4$, $Ti(OC_3H_7)_4$, $Ti(OC_4H_9)_4$, $CH_3Ti(OCH_3)_3$, $CH_3Ti(OC_2H_5)_3$, $CH_3Ti(OC_3H_7)_3$, $CH_3Ti(OC_4H_9)_3$, $C_2H_5Ti(OCH_3)_3$, $C_2H_5Ti(OC_2H_5)_3$, $C_2H_5Ti(OC_3H_7)_3$, $C_2H_5Ti(OC_4H_9)_3$.

Such alkoxy metal is, in a typical use, dissolved or dispersed in an organic solvent, water, a mixed solvent of the organic solvent and water, or the like, and if the alkoxy metal itself is in liquid form, it can be used as it is.

The alkoxy metal may have a solid concentration of the order of a range of from 10 wt % to 100 wt % in ordinary cases. The proportion of the alkoxy metal in the ceramic-type-coating agent ranges from 6 parts by weight to 30 parts by weight in solid conversions. Less than 6 parts by weight of the alkoxy metal is undesirable because it causes an insufficient thickness of the film, low hardness and low bonding force, whereas more than 30 parts by weight causes the film to be apt to splinter or to become a powder state.

The aforementioned organic solvent is used as a concentration adjustor and a hardening-rate adjustor for the alkoxy metal and as a dispersion medium for a fine-particulate inorganic substance. Examples of those used for producing the organic solvent include: lower alcohols such as methanol, ethanol, propanol and butanol; hydrocarbon ether alcohols such as ethylene glycol monoalkylether, diethylene glycol monoalkylether, and propylene glycol monoalkylether, having methyl, ethyl, propyl, butyl and the like serving as alkyl groups; and hydrocarbon ether acetates, such as ethylene glycol monoalkylether acetate, diethylene glycol monoalkylether acetate, and propylene glycol monoalkylether acetate.

As a solvent for the ceramic-type-coating agent, it is possible to use: acetic esters of ether alcohol or the like; acetic esters of alcohols, such as ethoxy ethyl acetate; esters such as methyl acetate, ethyl acetate, propyl acetate, and butyl acetate; acetone; or the like.

A second example of the ceramic-type-coating agent according to the present invention consists of at least one item selected from the group consisting of mixtures of the alkoxy metal and a silicone varnish.

This is consists of a mixture of the foregoing alkoxy metal and a pure silicone varnish which is expressed by a general formula $(R'_2Si)_n(OR)_2$ (wherein R' denotes an organic group having the carbon number of 1 to 8, and R denotes an alkyl group having the carbon number of 1 to 5 or an acyl group having the carbon number of 1 to 4), which produces a flexible coating film used as a bonding material for the above ceramic-type-coating agent. When the alkyl group is methyl, the thermal resistance and water repellency are enhanced.

Such mixture of the alkoxy metal and silicone varnish may be in the proportion of a range of from 10 to 70 parts by weight to a range of from 30 to 90 parts by weight (100 parts by weight in total) in solid conversions. The proportion of the mixture in the ceramic-type-coating agent ranges from 15 to 50 parts by weight in solid conversions, in which less than 15 parts by weight is undesirable because it causes an insufficient thickness of the film and a low bonding force, whereas more than 50 parts by weight causes the film to be apt to splinter or to have an extremely high viscosity.

A third example of the ceramic-type-coating agent according to the present invention consists of at least one item selected from the group consisting of mixtures of an alkali metal salt and a silicone varnish emulsion.

This consists of a mixture of alkali metal salt, which is expressed by a general formula $M'_2O \cdot nM \cdot mH_2O$ (wherein M' denotes Na, Li, K, and $NR_4$, M denotes $SiO_2$, $Al_2O_3$, $TiO_2$ and $ZrO_2$, n and m denote an integral number), and a silicone varnish which after emulsification displays an alkaline pH, which is used as an aqueous bonding agent for the above ceramic-type-coating agent to form a flexible and heat-resistant film.

Such mixture of the alkali metal salt and silicone varnish may be in the proportion of a range of from 10 to 60 parts by weight to a range of from 40 to 90 parts by weight (100 parts by weight in total) in solid conversions. The proportion of the mixture in the ceramic-type-coating agent ranges from 15 to 40 parts by weight in solid conversions, in which less than 15 parts by weight is undesirable because it causes an insufficient thickness of the film and a low bonding force, whereas more than 40 parts by weight causes the film to be apt to splinter or to have an extremely high viscosity.

After the ceramic-type-coating agent is applied to the base material such as paper, woven fabric or non-woven fabric, the ceramic-type-coating agent is hardened at room temperatures or by low-temperature heating, and undergoes hydrolysis and a polycondensation reaction. The resulting agent has the property of forming a ceramic film which is noncombustible and outstanding in its thermal resistance and weather resistance, and has a high water repellency and water proofing property due to its high density, and also electrical-insulation properties and shock impact resistance due to its high degree of hardness.

Figure 6:
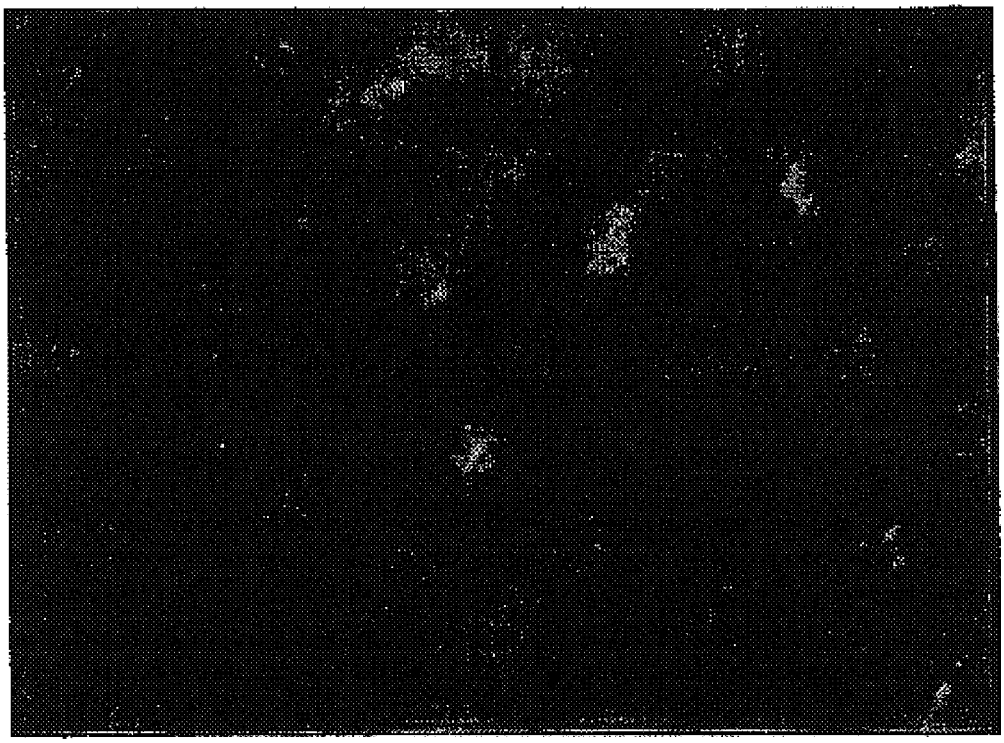
FIG. 6 is a photograph of a surface of a diaphragm including a glass cloth coated with metal alkoxide.

FIG. 6 is a photograph of a surface of the diaphragm including a glass cloth coated with the metal alkoxide.

Next, a description will be given of a method of manufacturing a speaker diaphragm with the use of the foregoing various ceramic-type-coating agents.

For the manufacture of the speaker diaphragm, besides using the ceramic-type-coating agent as described above, other ceramic-type-coating agents having properties similar to it can be also used.

With a method of manufacturing a speaker diaphragm in a first example, a fabric system material, e.g., paper; glass fiber; aramid fiber; metal oxide fiber or silica-alumina fiber, such as alumina fiber; liquid crystal polymer fiber; acrylic fiber; metal fiber; ceramic fiber; silicon carbide fiber; boron fiber; amorphous fiber; or fluorine fiber, is formed into a required shape of the diaphragm. Then, the material formed into the required shape of the diaphragm is impregnated or coated with the ceramic-type-coating agent.

In the above manufacturing method, it is possible to apply the ceramic-type-coating agent to the fiber material by a roll coat technique, a dip technique, a spray technique, a curtain flow technique, a printing technique or the like.

After the coating process, the drying and hardening of the coating film can proceed under room temperatures, but the application of heat reduces the drying time and effects a higher density in polymerization, leading to a denser ceramic layer. The heating conditions are 5 minutes to 60 minutes at 100 degrees C. to 300 degrees C., preferably, 10 minutes to 30 minutes at 150 degrees C. to 250 degrees C.

In order to enhance the electrical-insulation properties in the ceramic layer, it is desirable that after the coating and drying or the heat-drying of the ceramic-type-coating agent, the ceramic-type-coating agent is simply re-applied in one layer or more, and then dried and hardened to form two ceramic layers or more.

The coating weight of the ceramic-type-coating agent ranges from 20 parts by weight to 80 parts by weight per square meter in solid conversions, in which less than 20 parts by weight is undesirable because it causes an extremely small thickness of the film, leading to an insufficiency of electrical-insulation properties or reduced heat-emission properties, whereas more than 80 parts by weight causes the coating film to be apt to splinter or to have thermal insulation properties.

In order to form the diaphragm from the fiber-type material, when the material is paper, pulp or beaten paper-fibers are processed into paper, and when the material is woven fabric or non-woven fabric, the cloth sheet is pressed. Then the fiber-type material formed into a required shape of the diaphragm is impregnated or coated with the ceramic-type-coating agent.

With the above method, the ceramic-type-coating agent with which the shaped fiber-type material is impregnated or coated is solidified at room temperatures or by low-temperature heating, to produce a ceramic film on the surface of the fiber-type material.

In a method of manufacturing a speaker diaphragm in a second example, before proceeding to shaping of diaphragm, the ceramic-type-coating agent is mixed into the fibers of the fiber-type material such as pulp, beaten paper or others, and then the fibers of the material mixed equally with the ceramic-type-coating agent are processed into paper for the formation into the required shape of the diaphragm.

With the above method, the material fibers together with the ceramic-type-coating agent mixed therein are formed into the diaphragm of the required shape. Then the ceramic-type-coating agent is solidified at room temperatures or by low-temperature heating to produce a ceramic film on the surface of the material fibers shaping the diaphragm.

In a method of manufacturing a speaker diaphragm in a third example, the fiber-type material such as paper is impregnated or coated with the ceramic-type-coating agent in advance. The fiber-type material impregnated or coated with the ceramic-type-coating agent is beaten. Then the fibers are processed into paper for the formation into the required shape of the diaphragm.

With the above method, the ceramic-type-coating agent with which the fiber-type material is impregnated or coated is solidified at room temperatures or by low-temperature heating to produce a ceramic film. The resulting fiber-type material is beaten and then the diaphragm of the required shape is formed by the fibers on which the ceramic film is produced.

In another proposed example of the speaker diaphragm according to the present invention, a ceramic-type-coating agent, as used in the individual manufacture methods described above, includes a colloidal inorganic substance or a fine-particulate inorganic substance having favorable heat-emission properties.

The colloidal or fine-particulate inorganic substance is used for improving the heat-emission properties of the coating film produced from the foregoing ceramic-type-coating agent to promote heat-dissipation from the speaker diaphragm. The amount of heat-emission is proportional to the product of an emissivity and an emission area, in which the particle diameter of the inorganic substance is of the utmost importance.

The colloidal inorganic substance has particles of the order of 10 angstroms to 10.000 angstroms which disperse in a dispersion medium. For the dispersion medium, in most instances, water, or an organic solvent of a lower alcohol, a hydrocarbon, ethyl alcohols, acetic esters related to the lower alcohol, hydrocarbon or ethyl alcohols, or the like is used alone or in combination. The concentration of dispersion particles is commonly in a range of from 10 parts by weight to 60 parts by weight.

Specific examples of the colloidal inorganic substance are colloidal alumina, colloidal silica, colloidal zirconia, colloidal titania, colloidal cerium oxide, colloidal zirconium silicate, colloidal aluminum hydroxide, colloidal zirconium hydroxide, and the like.

A proper fine-particulate inorganic substance has favorable heat-emission properties and a particle diameter of the order of from 0.1 micro to 3.0 micro, of which examples include: metal oxide such as alumina, zirconia, titania, iron oxide, copper oxide, manganese oxide, nickel oxide, chromium oxide, cobalt oxide or the like; a synthetic thereof; aluminium silicate; zirconium silicate; aluminum hydroxide; zirconium hydroxide; and silicon nitride. And it is also possible to use a fibrous inorganic substance, e.g., potassium titanate, silicon nitride and aluminum oxide, having a diameter of the order of from 0.1 micro to 3.0 micro and a length of the order of from 5 micro to 20 micro.

The proportion of the colloidal or fine-particulate inorganic substance in the foregoing ceramic-type-coating agent ranges from 2 parts by weight to 20 parts by weight in solid conversions, in which less than 2 parts by weight is undesirable because it causes a reduction in heat-emission properties, whereas more than 20 parts by weight causes development of thermal-insulation properties.

For the ceramic-type-coating agent, various surface-active agents, various catalytic hardeners, an organic/inorganic acid, or the like can be used.

The ceramic-type-coating agent may include a mixture of the colloidal inorganic substance and the fine-particulate inorganic substance.

FIG. 2 shows composition examples (1 to 3) of the ceramic-type-coating agent according to the present invention.

A colloidal inorganic substance or a fine-particulate inorganic substance having favorable heat-emission properties can be produced from an impalpable powder of a variety of metal oxides having a high emissivity and the property of converting heat into infrared radiation for emission. This may be added to the ceramic-type-coating agent used in the foregoing individual manufacturing methods.

In the above example, the speaker diaphragm is constructed of the added colloidal inorganic substance or fine-particulate inorganic substance having favorable heat-emission properties together with the base material and the ceramic-type-coating agent. Hence, the efficiency of heat dissipation from the speaker diaphragm is significantly improved.

In yet another example, a fine-particulate inorganic substance consisting of at least one item selected from the group consisting of particulate metal, metal oxide, metal hydroxide, metal nitride, and metal carbide may be adhered on the diaphragm constructed according to each of the foregoing examples.

As the above fine-particulate inorganic substance, the fine-particulate inorganic substance included in the foregoing ceramic-type-coating agent, for example, is used.

According to the above example, the amount, location, thickness and the like of the adhesion of the fine-particulate inorganic substance with respect to the diaphragm are determined as appropriate. This allows for changes in the vibration frequency of the diaphragm 1, the adjustment of sound reflection or absorption for improving sound quality, and the setting of a desired sound quality.

In yet another example, it is proposed that a scaly inorganic substance or short-fibrous whisker inorganic substance be included in the ceramic-type-coating agent used in each of the foregoing manufacturing methods.

The scaly inorganic substance or short-fibrous whisker inorganic substance is a fine-particulate inorganic substance consisting of at least one item selected from the group consisting of particulate metal, metal oxide, metal hydroxide, metal nitride, and metal carbide. The fine-particulate inorganic substance is used as the fine-particulate inorganic substance included in the foregoing ceramic-type-coating agent, for example.

According to the above example, the amount, location, thickness and the like of the application of the fine-particulate inorganic substance with respect to the diaphragm are determined as appropriate. This allows for changes in the vibration frequency of the diaphragm 1, the adjustment of sound reflection or absorption for improving sound quality, and the setting of a desired sound quality.

FIG. 3 shows the characteristics of a speaker diaphragm made from conventional materials and a speaker diaphragm according to the present invention, from which it can be seen that the speaker diaphragm of the present invention shows favorable values in all the characteristics concerning specific gravity, Young's modulus and internal loss.

FIG. 4 shows the characteristics of a cone diaphragm constructed from a conventional paper-pulp without any treatment, and a cone diaphragm according to the present invention. As in the case of FIG. 3, it is seen from FIG. 4 that the speaker diaphragm of the present invention shows favorable values in all the characteristics concerning specific gravity, Young's modulus and internal loss.

The speaker diaphragm according to the present invention can be used for diaphragms of various shapes, e.g., a dome shape and a plane shape, as well as the cone-shaped diaphragm.

Further, the speaker diaphragm may also be used for a center cap.

In each of the manufacturing methods as described above, the speaker diaphragm is formed of a material combining ceramics and a base material produced from a fiber-type material such as a paper-based material, woven fabric or non woven fabric. For this reason, the following effects are to be noted.

The covering of the surface of a flammable base material with ceramics allows for the manufacture of incombustible or flame-retardant speaker-diaphragms. This prevents the speaker from bursting into flames owing to the diaphragm catching fire.

Further, the solidification of the ceramic-type-coating agent combined with the base material increases the rigidity of the diaphragm. Hence, it is possible to maintain endurance against impact even when the diaphragm is placed in a vehicle-mounted speaker, for example.

Since the rigidity of the diaphragm can be selectively set by adjusting composition or concentration of the ceramic-type-coating agent as appropriate, it is possible to provide a diaphragm in accordance with the desired characteristics of the speaker.

Still further, the ceramic film produced from the ceramic-type-coating agent is formed on the surface of the base material forming the diaphragm. This improves humidity resistance and water resistance and strengthens the binding between fibers. Thus, the diaphragms having high environmental resistance including thermal resistance are manufactured, so that they can be used in speakers which are placed in harsh environments where water is directly poured on them or the temperature and humidity are high, as in the case of a vehicle-mounted speaker, for example.

Figure 5:
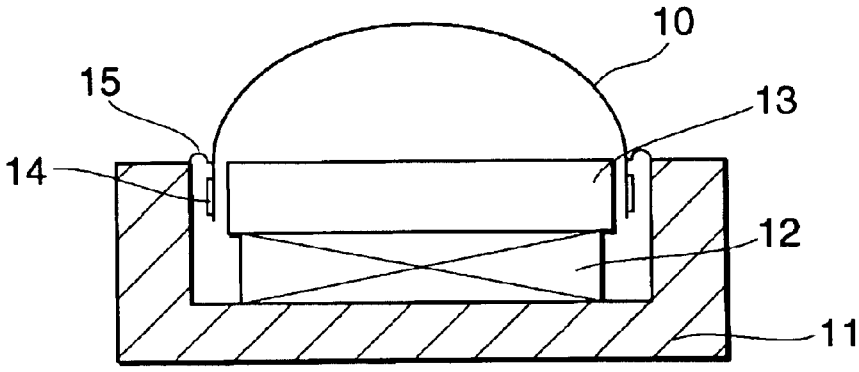
FIG. 5 is a sectional side view illustrating a configuration of a tweeter using a diaphragm relating to the present invention.

The provision of a lightweight diaphragm with a high rigidity as described above allows a diaphragm 10 to also offer full performance capacity for a tweeter serving as a speaker designed specially for high frequency as illustrated in FIG. 5.

FIG. 5 includes a yoke 11, a magnet 12, a pole piece 13, a voice coil 14 and an edge 15.

The terms and description used herein are set forth by way of illustration only and are not meant as limitations. Those skilled in the art will recognize that numerous variations are possible within the spirit and scope of the invention as defined in the following claims.

What is claimed is:

1. A method of manufacturing a speaker diaphragm, comprising the step of forming a material by combining a hardened ceramic coating agent with a fiber material into a shape of the speaker diaphragm.

2. A method of manufacturing the speaker diaphragm according to claim 1, comprising the steps of:

forming said fiber material into the shape of the speaker diaphragm; and impregnating or coating the fiber material, formed into the shape of the diaphragm, with said ceramic coating agent.

3. A method of manufacturing the speaker diaphragm according to claim 1, comprising the steps of:

mixing said ceramic coating agent into the fiber material in a separated fiber state before shaping; and processing the fiber material, mixed with the ceramic coating agent, into paper for formation into the shape of the speaker diaphragm.

4. A method of manufacturing the speaker diaphragm according to claim 1, comprising the steps of:

impregnating or coating said fiber material with said ceramic coating agent;

beating the fiber material impregnated or coating with the ceramic coating agent; and processing the beaten fiber material into paper for formation into the shape of the speaker diaphragm.

5. A speaker diaphragm, comprising a material formed by combining a hardened ceramic coating agent with a fiber material.

6. A speaker diaphragm according to claim 5, wherein said ceramic coating agent is made up of at least one item selected from the group consisting of an alkoxy metal, a hydrolysate of the alkoxy metal and a partial condensation product of the hydrolysate.

7. A speaker diaphragm according to claim 5, wherein said ceramic coating agent is made up of at least one item selected from the group consisting of mixtures of an alkoxy metal and a silicone varnish.

8. A speaker diaphragm according to claim 5, wherein said ceramic coating agent is made up of at least one item selected from the group consisting of mixtures of alkali metal salt and silicone varnish emulsion.

9. A speaker diaphragm according to claim 5, wherein said ceramic coating agent includes a colloidal inorganic substance or a fine-particulate inorganic substance having favorable heat-emission properties.

10. A speaker diaphragm according to claim 9, wherein said colloidal inorganic substance or fine-particulate inorganic substance having favorable heat-emission properties is an impalpable powder of metal oxide having the property of converting heat into infrared radiation for emission.

11. A speaker diaphragm according to claim 5, wherein a fine-particulate inorganic substance is adhered to the surface of said speaker diaphragm.

12. A speaker diaphragm according to claim 11, wherein said fine-particulate inorganic substance is a fine-particulate inorganic substance consisting of at least one item selected from the group consisting of a particulate metal, metal oxide, metal hydroxide, metal nitride, and metal carbide.

13. A speaker diaphragm according to claim 5, wherein said ceramic coating agent includes a scaly inorganic substance or a short-fibrous whisker inorganic substance.

14. A speaker diaphragm according to claim 13, wherein said scaly inorganic substance or short-fibrous whisker inorganic substance is a fine-particulate inorganic substance consisting of at least one item selected from the group consisting of a particulate metal, metal oxide, metal hydroxide, metal nitride, and metal carbide.

15. A speaker diaphragm according to claim 5, wherein said fiber material is either a paper-pulp based material, a woven fabric or a non-woven fabric.

* * * * *